US011643777B2

(12) United States Patent
Ji et al.

(10) Patent No.: US 11,643,777 B2
(45) Date of Patent: May 9, 2023

(54) METHOD FOR PREPARING DISSOLVING PULP BY TCF BLEACHING OF POPLAR KP

(71) Applicant: Qilu University of Technology, Jinan (CN)

(72) Inventors: Xingxiang Ji, Jinan (CN); Zhongjian Tian, Jinan (CN); Guihua Yang, Jinan (CN); Gaojin Lv, Jinan (CN); Wei Wei, Jinan (CN); Jiachuan Chen, Jinan (CN)

(73) Assignee: Qilu University of Technology, Jinan (CN)

( * ) Notice: Subject to any disclaimer, the term of this patent is extended or adjusted under 35 U.S.C. 154(b) by 180 days.

(21) Appl. No.: 17/003,352

(22) Filed: Aug. 26, 2020

(65) Prior Publication Data

US 2021/0062420 A1 Mar. 4, 2021

(30) Foreign Application Priority Data

Aug. 27, 2019 (CN) ..... 201910796683.9

(51) Int. Cl.

| | |
|---|---|
| ***D21C 9/10*** | (2006.01) |
| ***D21C 1/02*** | (2006.01) |
| ***D21C 9/153*** | (2006.01) |
| ***D21C 9/16*** | (2006.01) |
| ***D21H 11/04*** | (2006.01) |

(52) U.S. Cl.

CPC ..... *D21C 9/1057* (2013.01); *D21C 1/02* (2013.01); *D21C 9/1042* (2013.01); *D21C 9/153* (2013.01); *D21C 9/163* (2013.01); *D21H 11/04* (2013.01)

(58) Field of Classification Search

CPC ..... D21C 9/1057; D21C 1/02; D21C 9/153

See application file for complete search history.

(56) References Cited

U.S. PATENT DOCUMENTS 8,317,975 B2 * 11/2012 Amidon ..... D21C 3/00 162/87

FOREIGN PATENT DOCUMENTS

CN 107974856 A * 5/2018 ..... D21C 9/163

OTHER PUBLICATIONS

Gullichsen editor, Chemical Pulping 6A, 1999, Fapet Oy, pg. A137-A145, A245, chapter 9. (Year: 1999).*

* cited by examiner

*Primary Examiner* — Anthony Calandra

(74) *Attorney, Agent, or Firm* — Don D. Cha; HDC Intellectual Property Law, LLP

(57) ABSTRACT

The present application relates to a method for preparing dissolving pulp by TCF bleaching of poplar KP, including: preparing poplar KP by pre-hydrolysis kraft process with poplar as a raw material, and OZQP bleaching of the poplar KP to obtain dissolving pulp, wherein O denotes oxygen delignification, Z denotes ozone bleaching, Q denotes chelating treatment, and P denotes hydrogen peroxide bleaching. The dissolving pulp prepared by the same exhibits that all indexes can meet the requirements of excellent products in dissolving pulp industry standard (QB/T4898-2015), and most of the indexes are far superior to those of excellent products, and thus it can completely replace imported dissolving pulp.

7 Claims, No Drawings

METHOD FOR PREPARING DISSOLVING PULP BY TCF BLEACHING OF POPLAR KP

CROSS REFERENCE TO RELATED APPLICATION

This application claims the priority of Chinese Patent Application No. 201910796683.9, entitled "Method for preparing dissolving pulp by TCF bleaching of poplar KP" filed with the Chinese national intellectual property administration on Aug. 27, 2019, which is incorporated herein by reference in its entirety.

TECHNICAL FIELD

The invention belongs to the field of paper-making technology and new material, and particularly relates to a method for preparing dissolving pulp by TCF bleaching of poplar kraft pulp (KP).

BACKGROUND ART

The information in background art is only intended to increase the understanding of the present invention, and is not necessarily regarded as an acknowledgement or any form of suggestion that constitutes prior art known to those skilled in the art.

Dissolving pulp is a relatively pure fluff pulp after filtration, which is the main raw material for viscose fiber. In the fiber industry, viscose fiber and synthetic fiber are the main substitutes for cotton. Compared with synthetic fiber, viscose fiber has obvious advantages. Firstly, the raw material for viscose fiber is plant fiber, which is rich in resources and renewable; secondly, the texture of viscose fiber is closer to that of cotton fiber, and thus the features of comfort, breathability, environmental protection, etc of viscose fiber are superior to those of synthetic fiber. The raw materials for producing viscose fiber mainly include cotton dissolving pulp, wood dissolving pulp, bamboo dissolving pulp and bagasse dissolving pulp. According to relevant predictions, the production and demand of global fiber is increasing, and global fiber consumption will increase by 20 million tons annually by 2025, while in China and India, the growth rate of fiber demand per capita far exceeds the developed economies such as European Union, Japan and United States. Fibers derived from cotton in domestic are far from meeting the above demand. In recent years, due to the reduction in cotton production and the shrinkage of cotton wool production, wood dissolving pulp has become the main source of incremental viscose fiber. From 2010 to 2016, the average annual growth rate of dissolving pulp consumption in domestic was about 19%. In 2016, the overall demand for dissolving pulp in domestic was 4 million tons, among them the import volume of about 2.25 million tons and the domestic supply volume of 1 million tons, with huge market potential for dissolving pulp. After 2017, affected by the most stringent environmental protection policy in history, some dissolving pulp companies that have a great impact on environment were suspended, resulting in a tighter supply of dissolving pulp market.

Compared with grass material, wood raw material pulp is less bleachable and more difficult to bleach. At present, the research and application of TCF bleaching is mainly concentrated in grass raw materials. The main reason is that it is difficult to obtain high whiteness for wood raw material by TCF. Although there are reports in the literature that it is possible to obtain the whiteness of more than 90% for wood raw material by TCF, in this case the yield of fiber and dissolving pulp will drop significantly, with the yield of dissolving pulp generally less than 30%.

SUMMARY

In order to overcome the above problems, the present invention provides a method for preparing dissolving pulp by a new, green and environmentally-friendly totally chlorine-free (TCF) OZQP bleaching, in which poplar KP is used as a raw material. In this way, the wastewater generated by bleaching is completely free of harmful substances such as dioxin and AOX and has greatly reduced COD content, achieving "zero" discharge with recycling of wastewater generated by washing and bleaching. The high-quality dissolving pulp prepared by the method has no residual toxic substances, and exhibits that all indexes meet the requirements of excellent products in dissolving pulp industry standard (QB/T 4898-2015), and most of indexes are far superior to those of excellent products, and thus it can completely replace imported dissolving pulp. To a large extent, the use of the method solved the problems of large pollution in the production of dissolving pulp and shortage of raw materials for viscose fibers.

To achieve the above object, the present invention adopts the following technical scheme:

A method for preparing dissolving pulp by TCF bleaching of poplar KP, comprising:

preparing poplar KP by pre-hydrolysis kraft process with poplar as a raw material;

Performing OZQP bleaching on the poplar KP to obtain dissolving pulp, wherein O denotes oxygen delignification, Z denotes ozone bleaching, Q denotes chelating treatment, and P denotes hydrogen peroxide bleaching.

After studying, it has been found that the use of the bleaching (OZQP) of hot water pre-hydrolyzed poplar KP with poplar as raw material can achieve a high whiteness while maintaining a yield of about 35% for dissolving pulp. The dissolving pulp prepared in this way exhibits that all indexes can meet the requirements of excellent products in dissolving pulp industry standard (QB/T 4898-2015), and most of indexes are far superior to those of excellent products, and thus it can completely replace imported dissolving pulp. To a large extent, the use of the method solved the problems of large pollution in the production of dissolving pulp and shortage of raw materials for viscose fibers.

In some embodiments, the poplar is a fast-growing broad-leaved poplar, and the poplar is cut into chips with a length of 3-6 cm and a thickness of 2-5 mm to improve the water infiltration effect and pretreatment efficiency of the wood.

In some embodiments, the pre-hydrolysis kraft process comprises procedures of hot water pretreatment and kraft cooking, which can improve quality of prepared poplar dissolving pulp and have little environmental pollution.

In some embodiments, the hot water pretreatment comprises steps of: mixing poplar pieces and water according to a liquid ratio of 1:4-1:7, heating up to 150-170° C., and holding for 60-90 minutes. The use of the pretreatment improves the content and reaction capacity of α-cellulose in the pulp.

In some embodiments, the kraft cooking comprises steps of: performing cooking for 60-120 min at the liquid ratio of 1:4-1:6, the holding temperature of 150-180° C., the amount of alkali content (calculated as $Na_2O$) of 18-25%, and the degree of vulcanization of 18-25%. The prepared dissolving pulp has high content of α-cellulose and evenly distributed polymerization degree.

In some embodiments, O-stage comprises steps of: placing the poplar KP in an oxygen bleaching tank, introducing oxygen to an oxygen pressure of 0.4-0.8 Mpa, adding 1.5-3.5% of NaOH and 0.3-0.8% of $MgCO_3$, adjusting the concentration of the pulp to 8-15%, and then performing the bleaching reaction at 85-100° C. for 25-50 min; after the bleaching is completed, the pulp is washed to neutrality with water and concentrated to the concentration of 25-30%. Oxygen has a delignification effect in alkaline media to remove residual lignin after cooking.

In some embodiments, Z-stage comprises steps of: placing the pulp bleached and concentrated in O-stage in a reactor, adjusting the pH of pulp to 1.5-3.0 with acetic acid, adding 1.5-3.0% of ozone and 0.3-0.6% of tetrasodium iminodisuccinate (IDS), and then performing the reaction at 25-35° C. for 10-30 min while stirring at a speed of 60 r/min; excess ozone generated during the reaction enters the absorption device filled with KI solution through the gas outlet for absorption; after the reaction is completed, the pulp is washed with water to neutral and is adjusted to the concentration of 8-15%. According to the present application, in order to obtain better whiteness and quality of the pulp, after oxygen bleaching, ozone bleaching is used to remove lignin continuously, resulting in improving the whiteness of the pulp and avoiding the introduction of organic chlorides.

In some embodiments, Q-stage comprises steps of: placing the pulp bleached in Z-stage in a closed reactor, adding 0.3-0.6% of IDS (tetrasodium iminodisuccinate), stirring to mix IDS and the pulp uniformly, and then performing a chelation treatment at 60-90° C. for 20-40 min. After the research, it was found that pre-hydrolyzed poplar KP is bleached in O-stage and Z-stage and then chelated with IDS, so as to improve alkali resistance and brightness of the poplar KP.

In some embodiments, P-stage comprises steps of: after the reaction in Q-stage is completed, adding 1.5-3.0% of $H_2O_2$ directly to the pulp for bleaching, and also adding 0.6-1.0% of NaOH, 0.3-0.5% of DTPA (diethylenetriaminepentaaceticacid) and 0.1-0.3% of $MgCO_3$, and then performing the bleaching reaction at the temperature of 80-95° C. for 80-100 min; after the reaction is completed, the pulp is taken out, and then is washed to neutrality and dried to obtain dissolving pulp. The prepared dissolving pulp has good whiteness stability and excellent indexes.

The invention also provides a dissolving pulp prepared by any of the methods described above.

The invention also provides an application of the above dissolving pulp for preparing viscose fiber.

The present invention has the following beneficial effects:

(1) The high-quality dissolving pulp prepared by the method according to the application has no residue toxic substances, and exhibits that all indexes are superior to those of excellent products in dissolving pulp industry standard, and thus it can replace imported dissolving pulp completely. To a large extent, the use of the method solved the problems of large pollution in the production of dissolving pulp and shortage of raw materials for viscose fibers.

(2) The method for preparing dissolving pulp by TCF bleaching of poplar KP adopts hot water, ozone, hydrogen peroxide, a small amount of alkali and traces of other auxiliaries. In this way, the wastewater generated by bleaching is completely free of harmful substances such as dioxin and AOX and has greatly reduced COD content, achieving "zero" discharge with recycling of wastewater generated by washing and bleaching. The method is in line with the national industrial policy of resource conservation, energy conservation and emission reduction, and green development.

(3) The method according to the application is simple for operation and universal with low cost, and is easy for large-scale production.

DETAILED DESCRIPTION OF THE EMBODIMENTS

It should be noted that the following detailed descriptions are all exemplary and are intended to provide further explanation of the present application. Unless defined otherwise, all technical and scientific terms used herein have the same meaning as commonly understood by one of ordinary skill in the art to which the application belongs.

It should be noted that the terminology used herein is only for describing specific embodiments and is not intended to limit the exemplary embodiments according to the present application. As used herein, the singular forms are intended to include the plural forms as well, unless the context clearly indicates otherwise. Also, it should be understood that when the terms "comprising" and/or "including" are used in the specification, they indicate there are features, steps, operations, devices, components, and/or combinations thereof.

As described in the background, the current dissolving pulp is not good in quality and may cause serious environmental pollution. In view of this, the present invention provides an environmentally-friendly method for preparing dissolving pulp by bleaching poplar KP. The dissolving pulp prepared by the same has a high yield, and exhibits that all indexes can meet the requirements of excellent products in dissolving pulp industry standard (QB/T4898-2015), and most of the indexes are far superior to those of excellent products, and thus it can completely replace imported dissolving pulp.

An environmentally-friendly method for preparing dissolving pulp by bleaching poplar KP, in which fast-growing broad-leaved poplar is used as raw materials, comprising the following steps:

Cutting the naturally air-dried and purified poplar into poplar pieces with a length of 3-6 cm and a thickness of 2-5 mm;

performing hot water pretreatment on the poplar pieces: mixing the poplar pieces with water according to the liquid ratio of 1:4-1:7, heating up to 150-170° C., and holding for 60-90 min;

cooking the pre-treated poplar pieces by the kraft process for 60-120 min at the liquid ratio of 1:4-1:6, the holding temperature of 150-180° C., the amount of alkali (calculated as $Na_2O$) of 18-25%, and the degree of vulcanization of 18-25%; after the cooking is completed, the resulting substance is washed and concentrated to obtain poplar KP;

performing OZQP bleaching on the poplar KP (0-oxygen delignification, Z-ozone bleaching, Q-chelation treatment, P-hydrogen peroxide bleaching) to obtain dissolving pulp.

O-stage comprises steps of: placing the poplar KP in an oxygen bleaching tank, introducing oxygen to an oxygen pressure of 0.4-0.8 Mpa, adding 1.5-3.5% of NaOH and 0.3-0.8% of $MgCO_3$, adjusting the concentration of the pulp to 8-15%, and then performing the bleaching reaction at 85-100° C. for 25-50 min; after the bleaching is completed, the pulp is washed to neutrality with water and concentrated to the concentration of 25-30%.

Z-stage comprises steps of: placing the pulp bleached and concentrated in O-stage in a reactor, adjusting the pH of pulp to 1.5-3.0 with acetic acid, adding 1.5-3.0% of ozone and 0.3-0.6% of tetrasodium iminodisuccinate (IDS), and then performing the reaction at 25-35° C. for 10-30 min while stirring at a speed of 60 r/min; excess ozone generated during the reaction enters the absorption device filled with KI solution through the gas outlet for absorption; after the reaction is completed, the pulp is washed with water to neutral and is adjusted to the concentration of 8-15%.

Q-stage comprises steps of: placing the pulp bleached in Z-stage in a closed reactor, adding 0.3-0.7% of IDS (tetrasodium iminodisuccinate), stirring to mix IDS and the pulp uniformly, and then performing a chelation treatment at 60-90° C. for 20-40 min.

P-stage comprises steps of: after the reaction in Q-stage is completed, adding 1.5-3.0% of hydrogen peroxide ($H_2O_2$) directly to the pulp for bleaching, and also adding 0.6-1.0% of NaOH, 0.3-0.5% of DTPA and 0.1-0.3% of $MgCO_3$, and then performing the bleaching reaction at the temperature of 80-95° C. for 80-100 min; after the reaction is completed, the pulp is taken out, and then is washed to neutrality and dried to obtain dissolving pulp.

All chemical reagents used in the present invention are chemically pure.

In the present application, dissolving pulp is prepared by steps of preparing poplar KP by pre-hydrolysis of poplar as a raw material, and then performing totally chlorine-free OZQP bleaching on the poplar KP, and specifically by the following steps:

(1) Material preparation: cutting the naturally air-dried and purified poplar into poplar pieces with a length of 3-6 cm and a thickness of 2-5 mm.

(2) Hot water pretreatment of poplar pieces: mixing the poplar pieces with water according to the liquid ratio of 1:4-1:7, heating up to 150-170° C., and holding for 60-90 min.

(3) Kraft cooking of poplar: cooking the poplar pieces pretreated with hot water for 60-120 min at the liquid ratio of 1:4-1:6, the holding temperature of 150-180° C., the amount of alkali (calculated as $Na_2O$) of 18-25%, and the degree of vulcanization of 18-25%; after the cooking is completed, the resulting substance is washed and concentrated to obtain poplar KP.

(4) Oxygen delignification (O-stage) treatment: placing the poplar KP in an oxygen bleaching tank, introducing oxygen to an oxygen pressure of 0.4-0.8 Mpa, adding 1.5-3.5% of NaOH and 0.3-0.8% of $MgCO_3$, adjusting the concentration of the pulp to 8-15%, and then performing the bleaching reaction at 85-100° C. for 25-50 min; after the bleaching is completed, the pulp is washed to neutrality with water and concentrated to the concentration of 25-30%.

(5) Ozone bleaching (Z-stage): placing the pulp bleached and concentrated in O-stage in a reactor, adjusting the pH of pulp to 1.5-3.0 with acetic acid, adding 1.5-3.0% of ozone and 0.3-0.6% of tetrasodium iminodisuccinate (IDS), and then performing the reaction at 25-35° C. for 10-30 min while stirring at a speed of 60 r/min; excess ozone generated during the reaction enters the absorption device filled with KI solution through the gas outlet for absorption; after the reaction is completed, the pulp is washed with water to neutral and is adjusted to the concentration of 8-15%.

(6) Chelation treatment (Q-stage): placing the pulp bleached in Z-stage in a closed reactor, adding 0.3-0.7% of IDS, stirring to mix IDS and the pulp uniformly, and then performing a chelation treatment at 60-90° C. for 20-40 min.

(7) Hydrogen peroxide bleaching (P-stage): after the reaction in Q-stage is completed, adding 1.5-3.0% of hydrogen peroxide ($H_2O_2$) directly to the pulp for bleaching, and also adding 0.6-1.0% of NaOH, 0.3-0.5% of DTPA and 0.1-0.3% of $MgCO_3$, and then performing the bleaching reaction at the temperature of 80-95° C. for 80-100 min; after the reaction is completed, the pulp is taken out, and then is washed to neutrality and dried to obtain dissolving pulp. Various indexes of the dissolving pulp are measured.

The specific steps comprise:

(1) Cutting the naturally air-dried and purified poplar into poplar pieces with a length of 3-6 cm and a thickness of 2-5 mm.

(2) Mixing the poplar pieces with water according to the liquid ratio of 1:4-1:7, heating up to 150-170° C., and holding for 60-90 min.

(3) Cooking the poplar pieces pretreated in step (2) for 60-120 min at the liquid ratio of 1:4-1:6, the holding temperature of 150-180° C., the amount of alkali (calculated as $Na_2O$) of 18-25% and the degree of vulcanization of 18-25%; after the cooking is completed, the resulting substance is washed and concentrated to obtain poplar KP.

(4) Performing oxygen delignified (O-stage) on the poplar KP obtained in step (3): placing the poplar KP in an oxygen bleaching tank, introducing oxygen to an oxygen pressure of 0.4-0.8 Mpa, adding 1.5-3.5% of NaOH and 0.3-0.8% of $MgCO_3$, adjusting the concentration of the pulp to 8-15%, and then performing the bleaching reaction at 85-100° C. for 25-50 min; after the bleaching is completed, the pulp is washed to neutrality with water and concentrated to the concentration of 25-30%.

(5) Performing ozone bleaching (Z-stage) on the pulp obtained in step (4): adjusting the pH of pulp to 1.5-3.0 with acetic acid, adding 1.5-3.0% of ozone and 0.3-0.6% of tetrasodium iminodisuccinate (IDS), and then performing the reaction at 25-35° C. for 10-30 min while stirring at a speed of 60 r/min; excess ozone generated during the reaction enters the absorption device filled with KI solution through the gas outlet for absorption; after the reaction is completed, the pulp is washed with water to neutral and is adjusted to the concentration of 8-15%.

(6) Performing chelation treatment (Q-stage) on the pulp obtained in step (5): placing the pulp bleached in step (5) in a closed reactor, adding 0.3-0.7% of IDS, stirring to mix the pulp and IDS uniformly, and then performing a chelation treatment at 60-90° C. for 20-40 min.

(7) Performing the bleaching (P-stage) on the pulp obtained in step (6): adding 1.5-3.0% of hydrogen peroxide ($H_2O_2$) directly to the pulp for bleaching, and also adding 0.6-1.0% of NaOH, 0.3-0.5% of DTPA and 0.1-0.3% of $MgCO_3$, and then performing the bleaching reaction at the temperature of 80-95° C. for 80-100 min; after the reaction is completed, the pulp is taken out, and then is washed to neutrality and dried to obtain dissolving pulp.

(8) Drying the pulp obtained in step (7) to obtain dissolved pulp after, which is mainly used for the production of viscose fiber.

The technical solutions of the present application will be described below by specific embodiments. The following percentages (%) are mass percentages unless otherwise specified.

Example 1: The dissolving pulp is prepared by bleaching hot water pretreated poplar KP, and specifically by the following steps:

(1) Material preparation: cutting the naturally air-dried and purified poplar into poplar pieces with a length of 3-6 cm and a thickness of 2-5 mm.

(2) Hot water pretreatment of poplar pieces: mixing the poplar pieces with water in a reactor according to the liquid ratio of 1:5, heating up to 165° C., and holding for 90 min.

(3) Kraft cooking of poplar: cooking the poplar pieces pretreated with hot water for 90 min at the liquid ratio of 1:5, the temperature of 165° C., the amount of alkali (calculated as $Na_2O$) of 22%, and the degree of vulcanization of 24%; after the cooking is completed, the resulting substance is washed and concentrated to obtain hot water pretreated poplar KP.

(4) Oxygen delignification (O-stage) treatment: placing a certain mass (absolutely dry) of poplar KP in an oxygen bleaching tank, introducing oxygen to an oxygen pressure of 0.6 Mpa, adding 2.5% of NaOH and 0.5% of $MgCO_3$, adjusting the concentration of the pulp to 10%, and then performing the bleaching reaction at 90° C. for 30 min; after the bleaching is completed, the pulp is washed to neutrality with water and concentrated to the concentration of 28%.

(5) Ozone bleaching (Z-stage): placing the pulp bleached and concentrated in O-stage in a reactor, adjusting the pH of pulp to 2.5 with acetic acid, adding 2.0% of ozone and 0.5% of IDS, and then performing the reaction at 25° C. for 20 min while stirring at a speed of 60 r/min; excess ozone generated during the reaction enters the absorption device filled with KI solution through the gas outlet for absorption; after the reaction is completed, the pulp is washed with water to neutral and is adjusted to the concentration of 10%.

(6) Chelation treatment (Q-stage): placing the pulp bleached in Z-stage in a closed reactor, adding 0.5% of IDS, stirring at a speed of 60 r/min to mix IDS and the pulp uniformly, and then performing a chelation treatment in a water bath at 70° C. for 30 min.

(7) Hydrogen peroxide bleaching (P-stage): after the reaction in Q-stage is completed, adding 2.0% of hydrogen peroxide ($H_2O_2$) directly to the pulp for bleaching, and also adding 0.8% of NaOH, 0.3% of DTPA and 0.3% of $MgCO_3$, and then performing the bleaching reaction at the temperature of 90° C. for 90 min; after the reaction is completed, the pulp is taken out, and then is washed to neutrality and dried to obtain dissolving pulp. Various indexes of the dissolving pulp are measured and compared with those of the products in industry standard.

Example 2: The dissolving pulp is prepared by bleaching hot water pretreated poplar KP, and specifically by the following steps:

(1) Material preparation: cutting the naturally air-dried and purified poplar into poplar pieces with a length of 3-6 cm and a thickness of 2-5 mm.

(2) Hot water pretreatment of poplar pieces: mixing the poplar pieces with water in a reactor according to the liquid ratio of 1:4, heating up to 150° C., and holding for 90 min.

(3) Kraft cooking of poplar: cooking the poplar pieces pretreated with hot water for 100 min at the liquid ratio of 1:4, the temperature of 170° C., the amount of alkali (calculated as $Na_2O$) of 20%, and the degree of vulcanization of 22%; after the cooking is completed, the resulting substance is washed and concentrated to obtain poplar KP.

(4) Oxygen delignification treatment (O-stage): placing a certain mass (absolutely dry) of poplar KP in an oxygen bleaching tank, introducing oxygen to an oxygen pressure of 0.4 Mpa, adding 1.5% of NaOH and 0.3% of $MgCO_3$, adjusting the concentration of the pulp to 12%, and then performing the bleaching reaction at 100° C. for 50 min; after the bleaching is completed, the pulp is washed to neutrality with water and concentrated to the concentration of 25%.

(5) Ozone bleaching (Z-stage): placing the pulp bleached and concentrated in O-stage in a reactor, adjusting the pH of pulp to 2.0 with acetic acid, adding 1.5% of ozone and 0.6% of IDS, and then performing the reaction at 30° C. for 30 min while stirring at a speed of 60 r/min; excess ozone generated during the reaction enters the absorption device filled with KI solution through the gas outlet for absorption; after the reaction is completed, the pulp is washed with water to neutral and is adjusted to the concentration of 12%.

(6) Chelation treatment (Q-stage): placing the pulp bleached in Z-stage in a closed reactor, adding 0.4% of IDS, stirring at a speed of 60 r/min to mix IDS and the pulp uniformly, and then performing a chelation treatment in a water bath at 60° C. for 40 min.

(7) Hydrogen peroxide bleaching (P-stage): after the reaction in Q-stage is completed, adding 1.5% of hydrogen peroxide ($H_2O_2$) directly to the pulp for bleaching, and also adding 0.6% of NaOH, 0.4% of DTPA and 0.3% of $MgCO_3$, and then performing the bleaching reaction at the temperature of 90° C. for 80 min; after the reaction is completed, the pulp is taken out, and then is washed to neutrality and dried to obtain dissolving pulp. Various indexes of the dissolving pulp are measured and compared with those of the products in industry standard.

TABLE 1

Comparison of indexes of dissolving pulp prepared by OZQP bleaching of poplar KP and those of products in industry standard

| Items | Unit | Indexes of excellent/qualified products in industry standards | Measured indexes |
|---|---|---|---|
| Alkali resistance≥ | % | 93.0/90.0 | 98.2 |
| Polypentoses≤ | % | 4.0/4.5 | 3.6 |
| Ash content≤ | % | 0.12/0.15 | 0.10 |
| Iron content≤ | mg/kg | 15.0/20.0 | 9.2 |
| $D_{65}$ brightness≥ | % | 82.0 | 90.8 |
| Dichloromethane extracts≤ | % | 0.30/0.40 | 0.15 |
| Intrinsic viscosity | mL/g | 380~500/320~500 | 442 |
| Dustiness 0.05 $mm^2$~3.0 $mm^2$≤ | 60/80 | 60 | 30.6 |
| >3.0 $mm^2$ | | none | none |

TABLE 2

Comparison of indexes of dissolving pulp prepared by OZQP bleaching of poplar KP and those of products in industry standard

| Items | Unit | Indexes of excellent/qualified products in industry standards | Measured indexes |
|---|---|---|---|
| Alkali resistance≥ | % | 93.0/90.0 | 94.1 |
| Polypentose≤ | % | 4.0/4.5 | 4.1 |
| Ash content≤ | % | 0.12/0.15 | 0.12 |
| Iron content≤ | mg/kg | 15.0/20.0 | 13.4 |
| $D_{65}$ brightness≥ | % | 82.0 | 87.3 |
| Dichloromethane extract≤ | % | 0.30/0.40 | 0.25 |
| Intrinsic viscosity | mL/g | 380~500/320~500 | 455 |
| Dustiness 0.05 $mm^2$~3.0 $mm^2$≤ | 60 | 60 | 39.5 |
| >3.0 $mm^2$ | | none | none |

Example 3: The dissolving pulp is prepared by bleaching poplar KP, and specifically by the following steps:

(1) Material preparation: cutting the naturally air-dried and purified poplar into poplar pieces with a length of 3-6 cm and a thickness of 2-5 mm.

(2) Hot water pretreatment of poplar pieces: mixing the poplar pieces with water in a reactor according to the liquid ratio of 1:6, heating up to 170° C., and holding for 60 min.

(3) Kraft cooking of poplar: cooking the poplar pieces pretreated with hot water for 70 min at the liquid ratio of 1:5, the temperature of 175° C., the amount of alkali (calculated as $Na_2O$) of 22%, and the degree of vulcanization of 24%; after the cooking is completed, the resulting substance is washed and concentrated to obtain poplar KP.

(4) Oxygen delignification treatment (O-stage): placing a certain mass (absolutely dry) of poplar KP in an oxygen bleaching tank, introducing oxygen to an oxygen pressure of 0.8 Mpa, adding 3.5% of NaOH and 0.7% of $MgCO_3$, adjusting the concentration of the pulp to 10%, and then performing the bleaching reaction at 100° C. for 30 min; after the bleaching is completed, the pulp is washed to neutrality with water and concentrated to the concentration of 30%.

(5) Ozone bleaching (Z-stage): placing the pulp bleached and concentrated in O-stage in a reactor, adjusting the pH of pulp to 1.5 with acetic acid, adding 3.0% of ozone and 0.6% of IDS, and then performing the reaction at 25° C. for 20 min while stirring at a speed of 60 r/min; excess ozone generated during the reaction enters the absorption device filled with KI solution through the gas outlet for absorption; after the reaction is completed, the pulp is washed with water to neutral and is adjusted to the concentration of 10%.

(6) Chelation treatment (Q-stage): placing the pulp bleached in Z-stage in a closed reactor, adding 0.6% of IDS, stirring at a speed of 60 r/min to mix IDS and the pulp uniformly, and then performing a chelation treatment in a water bath at 80° C. for 30 min.

(7) Hydrogen peroxide bleaching (P-stage): after the reaction in Q-stage is completed, adding 3.0% of hydrogen peroxide ($H_2O_2$) directly to the pulp for bleaching, and also adding 1.0% of NaOH, 0.5% of DTPA and 0.3% of $MgCO_3$, and then performing the bleaching reaction at the temperature of 80° C. for 100 min; after the reaction is completed, the pulp is taken out, and then is washed to neutrality and dried to obtain dissolving pulp. Various indexes of the dissolving pulp are measured and compared with those of the products in industry standard.

TABLE 3

Comparison of indexes of dissolving pulp prepared by OZQP bleaching of poplar KP and those of products in industry standard

| Items | Unit | Indexes of excellent/qualified products in industry standards | Measured indexes |
|---|---|---|---|
| Alkali resistance≥ | % | 93.0/90.0 | 98.3 |
| Polypentose≤ | % | 4.0/4.5 | 2.8 |
| Ash content≤ | % | 0.12/0.15 | 0.1 |
| Iron content≤ | mg/kg | 15.0/20.0 | 9.4 |
| $D_{65}$ brightness≥ | % | 82.0 | 92.2 |
| Dichloromethane extract≤ | % | 0.30/0.40 | 0.15 |
| Intrinsic viscosity | mL/g | 380~500/320~500 | 409 |
| Dustiness 0.05 $mm^2$~3.0 $mm^2$≤ | 60 | 60 | 32.7 |
| >3.0 $mm^2$ | | none | none |

Finally, it should be noted that the above examples are only preferred embodiments of the present invention and are not intended to limit the present invention. Although the present invention is described in detail with reference to the foregoing embodiments, it can still modify the technical solutions described in the foregoing embodiments, or equivalently replace some of them for those skilled in the art. Any modification, equivalent replacement, or improvement made within the spirit and principle of the present invention shall be included in the protection scope of the present invention. Although the specific embodiments of the present invention are described above, they do not limit the scope of protection of the present invention. Those skilled in the art should understand that based on the technical solution of the present invention, various modifications or deformations that can be made by those skilled in the art without creative effort are still within the protection scope of the present invention.

What is claimed is:

1. A method for preparing dissolving pulp by TCF bleaching of poplar kraft pulp (KP), said method comprising:

preparing poplar KP from raw poplar using a pre-hydrolysis kraft process; and performing OZQP bleaching on the poplar KP to obtain dissolving pulp, wherein O denotes oxygen delignification, Z denotes ozone bleaching, Q denotes chelating treatment, and P denotes hydrogen peroxide bleaching, wherein ozone bleaching step Z comprises:

placing pulp bleached and concentrated from the O-stage in a reactor, adjusting pH of the pulp to 1.5-3.0 with acetic acid, adding 1.5-3.0% of ozone and 0.3-0.6% of tetrasodium iminodisuccinate (IDS) to obtain a mixture, and subjecting the mixture to a reaction at a temperature of 25-35° C. for 10-30 min while stirring at a speed of 60 revolutions/min;

removing excess ozone generated during the reaction through a gas outlet into an absorption device filled with KI solution; and washing the pulp with water to neutral, and adjusting the pulp to a concentration of 8-15%.

2. The method for preparing dissolving pulp by TCF bleaching of poplar KP according to claim 1, wherein the poplar is cut into chips with a length of 3-6 cm and a thickness of 2-5 mm.

3. The method for preparing dissolving pulp by TCF bleaching of poplar KP according to claim 2, wherein the pre-hydrolysis kraft process comprises water pretreatment and kraft cooking.

4. The method for preparing dissolving pulp by TCF bleaching of poplar KP according to claim 3, wherein the water pretreatment comprises steps of: (i) mixing poplar chips with water to form a first poplar chip mixture and heating said first poplar chip mixture at a temperature range of 150° C. to 170° C. for 60-90 min; or (ii) mixing poplar chips with water in the presence of an alkali in an amount (calculated as $Na_2O$) of 18-25% to form a second poplar chip mixture, and heating said second poplar chip mixture at a temperature range of from 150° C. to 180° C. for 60-120 min.

5. The method for preparing dissolving pulp by TCF bleaching of poplar KP according to claim 1, wherein O-stage comprises steps of: placing the poplar KP in an oxygen bleaching tank, introducing oxygen, adding 1.5-3.5% of NaOH and 0.3-0.8% of $MgCO_3$, adjusting the concentration of the pulp to 8-15%, and bleaching at 85-100° C. for 25-50 min; washing the pulp to neutrality with water, and concentrating the pulp to a concentration of 25-30%.

6. The method for preparing dissolving pulp by TCF bleaching of poplar KP according to claim 1, wherein Q-stage comprises steps of: placing the pulp bleached in the Z-stage in a closed reactor, adding 0.3-0.7% of tetrasodium iminodisuccinate (IDS) to form a chelating pulp mixture, stirring the chelating pulp mixture of IDS and the pulp uniformly, and performing a chelation treatment at 60-90° C. for 20-40 min.

7. The method for preparing dissolving pulp by TCF bleaching of poplar KP according to claim 1, wherein P-stage comprises steps of: after the reaction in the Q-stage is completed, adding 1.5-3.0% of hydrogen peroxide ($H_2O_2$) directly to the pulp for bleaching, and also adding 0.6-1.0% of NaOH, 0.3-0.5% of DTPA and 0.1-0.3% of $MgCO_3$, and performing the bleaching reaction at the temperature of 80-95° C. for 80-100 min forming a peroxided bleached pulp mixture; removing the pulp from the peroxided bleached pulp mixture, washing the pulp to neutrality, and drying the pulp.

* * * * *